United States Patent [19]

Cortopassi

[11] Patent Number: 4,573,570

[45] Date of Patent: Mar. 4, 1986

[54] TACO SUPPORT

[75] Inventor: Jeffery J. Cortopassi, Santa Anna, Calif.

[73] Assignee: Taco Bell, Irvine, Calif.

[21] Appl. No.: 623,477

[22] Filed: Jun. 22, 1984

[51] Int. Cl.[4] ..... B65D 65/16

[52] U.S. Cl. ..... 206/45.33; 206/45.19; 229/DIG. 13; 248/174; 426/124; 426/128; 426/396

[58] Field of Search ..... 206/45.33, 45.19; 229/DIG. 13; 248/174; D9/433, 455, 456; 426/124, 128, 396

[56] References Cited

U.S. PATENT DOCUMENTS

| | | | |
|---|---|---|---|
| D. 233,158 | 10/1974 | Lowe, Jr. | D9/433 |
| D. 249,218 | 9/1978 | Mathison et al. | D9/433 |
| 1,172,667 | 2/1916 | Bunnell . | |
| 1,480,681 | 1/1924 | Goes . | |
| 2,528,016 | 10/1950 | Smith | 229/30 |
| 2,638,212 | 5/1953 | Robertson | 206/372 |
| 2,708,085 | 4/1955 | Bonaccorsi . | |
| 2,736,475 | 2/1956 | Lehman . | |
| 2,900,667 | 8/1959 | Longenecker | 248/174 |
| 2,979,191 | 4/1961 | Krassay et al. | 206/45.33 |
| 3,263,820 | 8/1966 | McFadden . | |
| 3,382,986 | 5/1968 | Pfeiffer . | |
| 3,561,453 | 2/1971 | Kline | 248/152 |
| 3,861,576 | 1/1975 | Tolaas et al. | 426/128 |
| 4,018,905 | 4/1977 | Adamek et al. | 206/45.33 |
| 4,164,588 | 8/1979 | Johnson | 426/124 |
| 4,269,316 | 5/1981 | Growney | 426/124 |
| 4,270,660 | 6/1981 | Putt . | |
| 4,362,247 | 12/1982 | Rueda . | |

FOREIGN PATENT DOCUMENTS

| | | | |
|---|---|---|---|
| 342538 | 9/1904 | France | 426/128 |
| 1545051 | 5/1979 | United Kingdom | 426/124 |
| 2052443 | 1/1981 | United Kingdom | 206/45.33 |

*Primary Examiner*—William Price
*Assistant Examiner*—Brenda J. Ehrhardt
*Attorney, Agent, or Firm*—Scully, Scott, Murphy & Presser

[57] ABSTRACT

A structural support for a taco, for protecting the taco when packaged in an overwrap, and also serving as a taco stand to maintain an unwrapped taco in an upright position. The support is constructed from an elongated paperboard blank formed into an interlocked structural support with a flat base member and a forwardly projecting front. The front projects forwardly in a substantially semicircular shape such that a taco can be laid on its side on top of the flat base member and within the semicircular front, and the thusly protected taco can then be packaged with an overwrap for sale by a fast food restaurant. The taco support also has a pair of opposed, upwardly facing cutouts therein symmetrically positioned on opposite sides of the projecting front. Each cutout has a cross section substantially in the shape of a taco base, and an unwrapped taco can be placed in and supported upright across the opposed cutouts, or a partially eaten taco can be supported upright by only a single cutout, with the taco being supported in many possible positions, such that the structural support also serves as a taco stand for either a whole or partially eaten taco.

8 Claims, 6 Drawing Figures

TACO SUPPORT

BACKGROUND OF THE INVENTION

1. Field of the Invention

The present invention relates generally to a versatile taco support which provides a structural support for a taco for packaging in an overwrap, and which also serves as a taco stand for an unwrapped taco. More particularly, the subject invention pertains to a structural support as described which is easily and conveniently constructed from a simple and relatively inexpensive paperboard blank, such that it is designed to be compatible with a taco fast food operation.

2. Discussion of the Prior Art

Taco fast food restaurants sell a large number of tacos packaged for removal by a customer for consumption at a nearby table or booth, or for removal and consumption as a take-out item. Tacos present some unusual packaging problems because the taco shell, which is formed of a hardened tortilla in the shape of a trough-like structure, is quite brittle. Accordingly, a taco package suitable for use in a fast food operation should provide adequate protection for the relatively brittle taco shell. Moreover, a taco typically has the taco shell filled with various loose comestible taco ingredients, and after unwrapping thereof, the taco should preferably be maintained in an upright, generally vertical position. Also, during consumption a taco is typically handled a number of different times, and it would be desirable if the taco support also provided a taco stand for an unwrapped taco or a partially eaten taco, such that the taco stand could conveniently maintain the unwrapped or partially eaten taco in an upright position.

Packaging for tacos by a Mexican or taco fast food restaurant should also be accomplished with minimal costs as the packaging materials are designed to be disposable throw-away items. In view of these cost constraints, tacos are frequently packaged with only a paper overwrap, which does not provide a great deal of protection against breakage of the brittle taco shell.

Taco holders provided by the prior art have frequently been designed as nondisposable stands designed to be reused a number of times. For instance, Putt U.S. Pat. No. 4,270,660 discloses a V-shaped taco holder designed to be constructed from plastic by an injection molding operation. In one embodiment, a V-shaped taco holder is provided with downwardly extending support legs, while in an alternative embodiment the taco holder is provided with a flat bottom such that it is free standing without legs. Rueda U.S. Pat. No. 4,362,247 discloses a taco stand constructed from a pair of spaced legs which are recessed at their upper ends to accommodate the curved lower end of an open, upwardly-facing V-shaped taco receiving holder. The taco holder comprises a pair of flat diverging walls such that a taco may be inserted therebetween and be horizontally supported in the lower end, and may be lifted therefrom for consumption.

Neither of these patents provides a disposable taco support similar to the present invention which provides both a protective support for a taco for packaging in an overwrap and also a taco stand for supporting an unwrapped taco.

SUMMARY OF THE INVENTION

Accordingly, it is a primary object of the present invention to provide a versatile taco support for a taco packaged with a wrap which also provides a stand for an unwrapped taco.

A further object of the subject invention is the provision of a versatile taco support as described which is constructed in a relatively simple manner from an inexpensive and easily manufactured paperboard blank.

In accordance with the teachings herein, the present invention provides a unique structural support for a taco, for protecting the taco when packaged in an overwrap, and also serving as a taco stand to maintain an unwrapped taco in an upright position. The support is constructed from an elongated paperboard blank formed into an interlocked structural support with a flat base member and a forwardly projecting front. The front projects forwardly in a substantially semicircular shape such that a taco can be laid on its side on top of the flat base member and within the semicircular front, and the thusly protected taco can then be packaged with an overwrap for sale by a fast food restaurant. The taco support also has a pair of opposed, upwardly facing cutouts therein symmetrically positioned on opposite sides of the projecting front. Each cutout has a cross section substantially in the shape of a taco base, and an unwrapped taco can be placed in and supported upright across the opposed cutouts, or a partially eaten taco can be supported upright by only a single cutout, with the support being capable of supporting a taco in many possible positions, such that the structural support also serves as a taco stand for either a whole or partially eaten taco.

In a preferred embodiment, the elongated paperboard blank is formed into a closed structural support by interengaging ends, preferably located centrally along the flat base member. The flat base member is folded relative to the forwardly projecting front by a pair of V angled fold lines located by each of two rear corner locations, defined where the projecting front joins the flat base. In greater particularly, proceeding from the flat base member, the elongated support member is folded upwardly through approximately 90° along the first pair of angled fold lines, and then is folded through approximately 180° along the second pair of angled fold lines, at each of two rear corner locations of the structural support, and then proceeds into the forwardly projecting front.

An additional pair of cutouts is also provided in the top surface of the blank in front of the V angled fold lines, to remove a portion of the top surface thereat, such that the top of the forwardly projecting front approximates the shape of the top surface of a taco laid therein. This functions to alleviate stressing and possible tearing of a wrap placed therearound, while also providing for a snugly fitting taco overwrap.

BRIEF DESCRIPTION OF THE DRAWINGS

The foregoing objects and advantages of the present invention for a versatile taco support may be more readily understood by one skilled in the art, with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
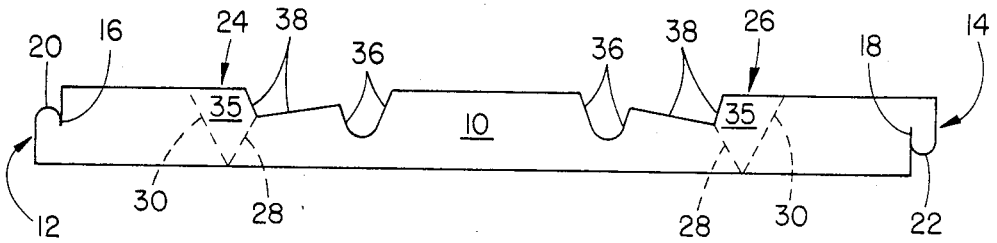
FIG. 1 illustrates an exemplary embodiment of a flat paperboard blank prior to folding and formation thereof into a taco structural support pursuant to the teachings of the present invention.
Figure 2:
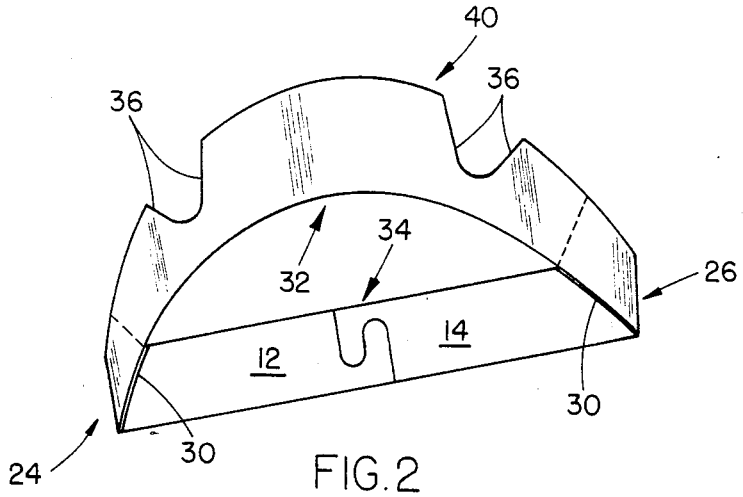
FIG. 2 is a bottom frontal view of a set-up taco support, constructed and assembled from the paperboard blank of FIG. 1.

Referring to the drawings in detail, FIG. 1 illustrates an exemplary embodiment of a flat paperboard blank 10 constructed pursuant to the teachings of the present invention, prior to folding and formation thereof into a taco structural support as taught herein.

The flat blank 10 includes a pair of ends 12 and 14 having a pair of interengaging cutout slits 16 and 18 therein. The end 12 has a slit 16 adapted to interengage an oppositely extending slit 18 in the opposite end 14. A pair of oppositely disposed rounded tabs 20, 22 are formed respectively at ends 12 and 14 to facilitate the interengagement of the ends. When the flat blank is formed into a closed structural support, as illustrated in FIGS. 2 through 6, the interengaged ends 12 and 14 form part of a flat base 34, adapted to lie flat on a support such as a table, with the base extending to a first pair of fold lines 30.

In an assembled condition, the blank folds along first and second pairs of V angled fold lines 28 and 30, with the fold lines 28 being located at each of two corner locations 24, 26, from which a bowed front 32 projects in a forwardly direction. In the assembled condition, the blank 10 folds upwardly through approximately 90° along fold lines 30 such that two quadrilaterally shaped areas 35 lie flat against the inner surface of the two rear ends of the forwardly projecting bowed front 32. The blank then folds again, approximately 180° back upon itself along a second pair of fold lines 28, and then extends into the forwardly projecting bowed front 32.

The fold lines 28, 30 can be formed by intermittent cuts in the blank, or by sharp creases, or by any other common method of formation thereof. The interengaging ends 12 and 14 are preferably formed centrally in the flat base portion of the blank wherein they are not subjected to any bending stress, as might occur in the bowed front portion 32.

When the blank is folded along the fold or crease lines 28 and 30 as just described and the ends thereof 12 and 14 are interengaged, the front 32 bows smoothly forwardly, without any sharp folds or creases therein, from the 180° folds at fold lines 28 such that the bowed front 32 forms a somewhat elongated semicircular structure. A pair of opposed, upwardly facing cutouts 36, each having a cross sectional shape of a taco base, are formed in the top surface of the bowed front 32 symmetrically positioned on opposite sides thereof. Moreover, an additional pair of cutouts 38 are also formed generally above and forwardly of the fold lines 28. As illustrated best in FIGS. 1 and 3, the cutouts 38 remove a portion of the top surface of the blank such that the top of the forwardly projecting front 32 approximates the shape of the top surface of a taco laid therein. This shape alleviates stressing, and possible tearing, of a wrap placed around the taco, while also providing for a snugly fitting overwrap.

Figure 3:
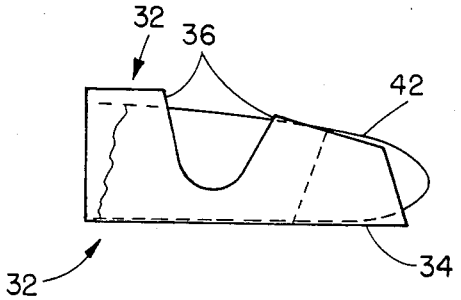
FIG. 3 illustrates a side elevational view of the taco structural support of FIG. 2 with a taco placed on its side therein.
Figure 4:
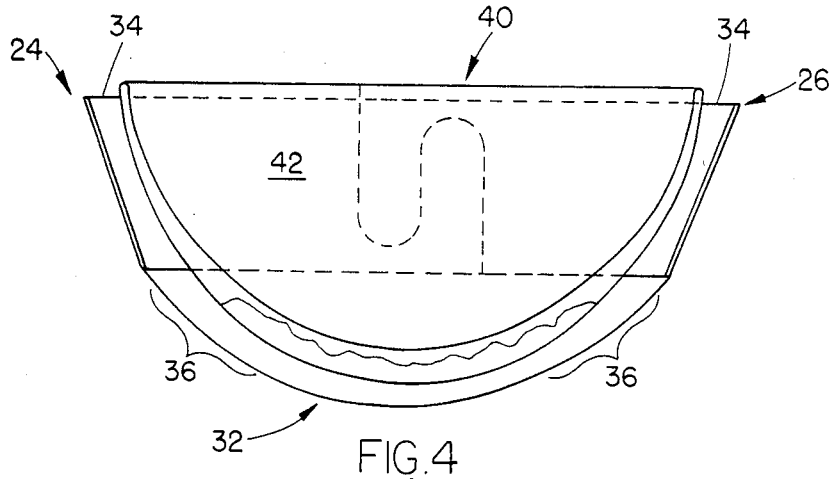
FIG. 4 is a plan view of the taco structural support with a taco placed on its side therein, similar to FIG. 3, prior to packaging with an overwrap.

After the taco support is assembled, it is ready to be used in packaging a taco 42, which can be placed on its side within the bowed front 32 on top of the flat base thereof, as illustrated in FIGS. 3 and 4. A paper overwrap is then placed around the taco and taco support, and the packaged taco is ready for delivery to a customer. In this packaging arrangement, the fragile taco shell is protected by the surrounding paperboard taco support.

Figure 5:
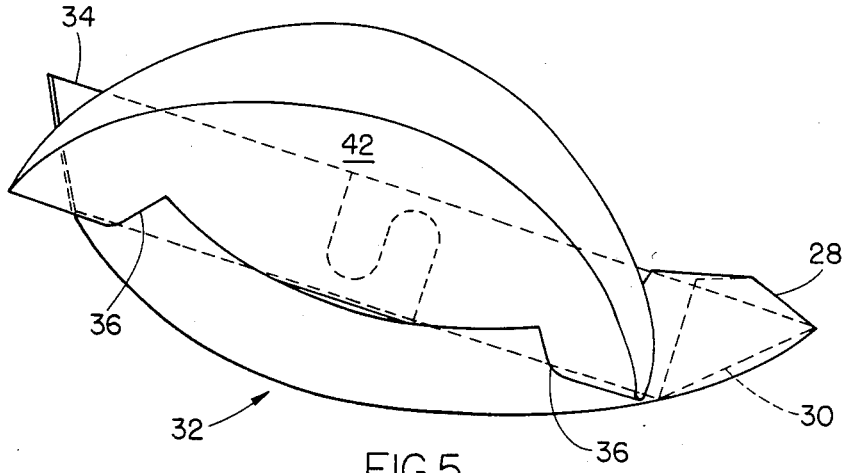
FIG. 5 illustrates a frontal perspective view of the taco structural support with a whole taco placed thereon, such that the support now serves as a stand for an unwrapped taco.
Figure 6:
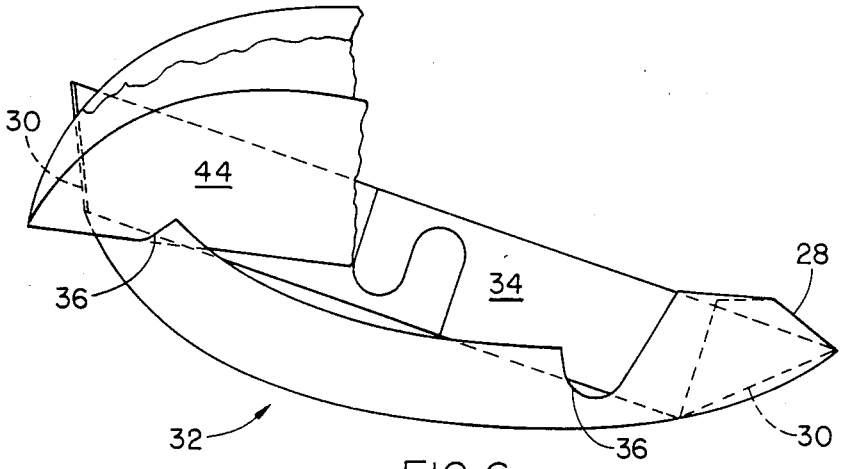
FIG. 6 is a frontal perspective view similar to FIG. 5, but wherein a partially eaten taco is supported across the back and one of the top cutouts of the support.

After removal of the paper overwrap, the upwardly facing cutouts 36 can serve to support the taco in an upright substantially vertical position as illustrated in FIG. 5, with the taco support now serving as a stand for the unwrapped taco or for a partially eaten taco. The taco stand is capable of supporting a whole taco or a partially eaten taco in many possible positions. A whole taco can be simply placed and supported across the two oppositely disposed cutouts 36, as illustrated in FIG. 5. FIG. 6 illustrates a partially eaten taco 44 supported in an upright substantially vertical position by only one of the upwardly facing cutouts 38, and extending therefrom onto the flat base of the support. After consumption of the taco, the disposable paperboard taco support can be conveniently thrown away.

While a preferred embodiment of the present invention for a taco support is described in detail herein, it should be apparent that the disclosure and teachings of the present invention will suggest many alternative designs to those skilled in the art. For instance, the configuration of the fold lines at the corners 24, 25 can vary in alternative embodiments. The interengaging ends 12 and 14 could have alternative constructions, and could be placed at other locations on the taco support, other than in the middle of the base thereof, or a suitable adhesive could also be utilized. The shape and placement of the taco support cutouts 36 could also vary considerably in alternative embodiments.

A folded paperboard blank 10 is enclosed herewith in an attached envelope as a model for submission with this patent application.

What is claimed is:

1. A structural support for a taco, for protecting the taco when packaged in a wrap, and also serving as a taco stand to maintain an unwrapped taco in an upright position, comprising an elongated support member formed into a closed structural support having a relatively flat base and a forwardly projecting bowed front, said elongated support member being folded upwardly through approximately 90° from said flat base along a first pair of angled fold lines and then being folded through approximately 180°, along a second pair of angled fold lines at each of two rear corner locations, into the forwardly projecting front, with the forwardly projecting bowed front being in the general shape of, but slightly larger than, a side profile of a taco, such that a taco can be placed on its side on said flat base and within the forwardly projecting bowed front, with the taco being protected thereby for wrapping, and said elongated support member also having a top edge defining a pair of opposed upwardly facing cutouts therein positioned on opposite sides of said projecting bowed front, whereby a taco can be placed in and supported upright by the opposed cutouts such that the structural support also serves as a taco stand.

2. A structural support for a taco as claimed in claim 1, each of said first pair of angled fold lines forming a V in the elongated support member with one of said second pair of angled fold lines.

3. A structural support for a taco as claimed in claim 2, said top edge having an additional pair of cutouts formed therein generally above and in front of said second pair of fold lines, to remove a portion of the top edge at said V fold lines to prevent stressing and possible tearing of a wrap placed therearound.

4. A structural support for a taco as claimed in claim 3, said elongated support member being formed into a closed structural support by interengaging ends which are located along said flat base.

5. A structural support for a taco as claimed in claim 4, said elongated member being formed of a relatively stiff paperboard material.

6. An elongated member paperboard blank for formation into the structural support claimed in claim 4.

7. An elongated member paperboard blank for formation into the structural support claimed in claim 1.

8. A structural support for a taco as claimed in claim 1, in combination with a taco positioned within the structural support, with the taco positioned with one side on said flat base, and the curved top of the taco being placed within and closely adjacent to said forwardly projecting bowed front.

* * * * *